US006563037B2

(12) United States Patent
Hamilton

(10) Patent No.: US 6,563,037 B2
(45) Date of Patent: May 13, 2003

(54) GUITAR STRING ATTACHMENT DEVICE

(76) Inventor: Richard Hugh Hamilton, 1224 W. Bristol Rd., Flint, MI (US) 48507

( * ) Notice: Subject to any disclaimer, the term of this patent is extended or adjusted under 35 U.S.C. 154(b) by 0 days.

(21) Appl. No.: 09/934,824

(22) Filed: Aug. 22, 2001

(65) Prior Publication Data

US 2003/0037663 A1 Feb. 27, 2003

(51) Int. Cl.[7] ..... G10G 7/00
(52) U.S. Cl. ..... 84/484
(58) Field of Search ..... 84/458, 459, 457, 84/454, 453, 455, 312 R

(56) References Cited

U.S. PATENT DOCUMENTS

| | | | | | |
|---|---|---|---|---|---|
| 3,479,917 | A | | 11/1969 | Zitnik, Jr. et al. | 84/312 |
| 3,596,552 | A | | 8/1971 | Lager | 84/207 |
| 3,677,126 | A | | 7/1972 | Pierce | 84/312 |
| 3,813,983 | A | | 6/1974 | Paul | 84/458 |
| 4,088,052 | A | | 5/1978 | Hedrick | 84/454 |
| 4,112,808 | A | | 9/1978 | Ketterer | 84/453 |
| 4,197,780 | A | * | 4/1980 | Smith | 84/453 |
| 4,252,048 | A | * | 2/1981 | Pogoda | 84/454 |
| 4,378,723 | A | | 4/1983 | Scholz | 84/297 R |
| 4,497,236 | A | | 2/1985 | Rose | 84/298 |
| 4,517,874 | A | | 5/1985 | Fender | 84/314 N |
| 4,535,670 | A | | 8/1985 | Borisoff | 84/312 R |
| 4,549,461 | A | | 10/1985 | Rose | 84/313 |
| 4,555,970 | A | | 12/1985 | Rose | 84/313 |
| 4,562,766 | A | | 1/1986 | Scholz | 84/297 R |
| 4,690,028 | A | | 9/1987 | Steinberger | 84/314 N |
| 4,696,218 | A | | 9/1987 | Hoshino et al. | 84/297 R |
| 4,878,413 | A | | 11/1989 | Steinberger | 84/314 N |
| 5,140,884 | A | | 8/1992 | Bowden | 84/312 R |
| 5,277,094 | A | | 1/1994 | Spuler | 84/298 |
| 5,567,897 | A | | 10/1996 | McEwen | 84/312 R |
| 5,569,863 | A | * | 10/1996 | Lem | 84/312 R |
| 5,686,677 | A | | 11/1997 | Herbert | 84/307 |
| 5,854,437 | A | | 12/1998 | Merrick et al. | 84/454 |
| D421,882 | S | | 3/2000 | Mattei | D8/29 |
| 6,043,422 | A | | 3/2000 | Chapman | 84/723 |
| 6,107,556 | A | | 8/2000 | Gilliam | 84/454 |
| 6,255,575 | B1 | * | 7/2001 | Pearse | 84/312 R |

* cited by examiner

*Primary Examiner*—Kim Lockett
(74) *Attorney, Agent, or Firm*—Gifford, Krass, Groh, Sprinkle, Anderson & Citkowski, P.C.

(57) ABSTRACT

A tool for use with a guitar for establishing a proper degree of pre-tightening slack in each of a plurality of guitar strings attached to respective head and rear locations of the guitar and prior to final tightening and wrapping of the strings. A substantially planar and elongate extending body includes a lower end having first and second locating feet extending from the body for locating the tool in substantially upwardly extending fashion relative to a selected one of the frets of the guitar neck. The tool also includes an upper end having a plurality of individually stepped shoulders corresponding to each of the plurality of guitar strings to be installed. A removal portion is integrally defined in the body and is adapted to remove pegs installed at the rear location of the guitar. Tuning spindles are located on a head of the guitar and each further includes a locking nut portion rotatably associated with an upwardly extending pintle. The tool further includes an integrally defined wrench portion adapted to rotatably engaging a selected one of the locking nut portions. In use, each guitar string is drawn over a selected stepped shoulder of the tool arrayed upon the guitar neck and so that a trailing end of the string is engaged with an associated tuning spindle with the string taut while the tool is in place. Upon removal of the tool from the guitar frets, the locking nut for each of the tuning spindles is engaged by the wrench portion and rotated a selected number of turns to wrap and tension the string.

13 Claims, 2 Drawing Sheets

GUITAR STRING ATTACHMENT DEVICE

BACKGROUND OF THE INVENTION

1. Field of the Invention

The present invention relates generally to implements for use with a guitar for properly affixing and tensioning each of the guitar's strings. More specifically, the present invention discloses a tool implement for use with the guitar, its neck and frets, and for the purpose of establishing a proper degree of initial spacing or slack in each of the guitar strings upon initially attaching to respective head and rear locations on the guitar, and prior to tightening/wrapping the strings about the guitar head.

2. Description of the Prior Art

The prior art is well documented with examples of guitar string implements utilized for such purposes as fastening, tuning and the like. The objective in each instance is to correctly install and tension the several strings of the guitar.

U.S. Pat. No. 6,107,556, issued to Gilliam, references a hand held device for tensioning and stabilizing the guitar strings during tuning and installation. The device comprises a structure having a pair of arms defining a substantially forked or "V" shape. In use, the device is positioned against the neck of the guitar and a string is threaded between a pair of spools on at least one of the arms. The device is then pivoted about an apex so that selected string guides extending from the body engage and lift the string away from the guitar neck and apply tension thereto during the tuning and installation of the string. As further stated in its disclosure, Gilliam operates under the "trial and error" principle of most prior art tuning devices for establishing the tensioning of the string during the tuning or installation process.

U.S. Pat. No. 4,696,218, issued to Hoshino, teaches a fastening means for guitar strings in the form of a pivoting lever mounted to the body of the guitar and moveable between both string relaxing and string tensioning positions. The lever is secured to a string by a ball-like retaining member that is clamped to the string at a predetermined location near the tail end thereof. Preferably, the clamping takes place shortly prior to securing the string to the lever and the retaining member is provided with at least one groove through which the string extends. The retaining member is deformed by crushing the same at portions thereof that defines at least one groove thereby collapsing the groove around the string to firmly clamp the retaining member to the string.

Other and additional string clamping devices along the same conceptual lines are taught by Steinberger, U.S. Pat. Nos. 4,690,028 and 4,878,413; and Scholz, U.S. Pat. No. 4,562,766. Additional examples of guitar pull string devices operable from the tail end include McEwen, U.S. Pat. No. 5,567,897 and Bowden, U.S. Pat. No. 5,140,884.

Also of note is U.S. Pat. No. 4,197,780, issued to Smith, which teaches an apparatus for inducing pitch stability in musical strings. A tensioned string is placed in a fractioning channel provided in the apparatus, which is then caused to traverse the length of the strength repeatedly to maximize both its elongation and tensional stability.

Finally, the piano stringing device of U.S. Pat. No. 3,596,552, issued to Lager, discloses a swingably mounted tension element having an arcuate portion and a likewise arcuate groove therein. A string is placed in a state folded back upon itself and so as to be clamped in a groove in the rotating device by wedge action when the element is swung, and thereby tensioned.

SUMMARY OF THE PRESENT INVENTION

The present invention discloses a tool implement for use with the guitar, its neck and frets. In particular the tool of the present invention is utilized with the guitar head and frets for the purpose of establishing a proper degree of initial spacing (or slack) in each of the individual guitar strings (typically E, A, D, G, B, E (high)) when initially attached to respective head and rear locations on the guitar, and prior to tightening/wrapping the strings about the guitar head. The purpose of having the proper amount of initial slack is to ensure the proper number of wraps around the spindle, with each spindle requiring a different number of wraps. Too few wraps will result in not staying in tune. Too many wraps will cause string breakage.

The tool includes a substantially planar and elongate extending body having a specified length, width and thickness and which includes a lower end with first and second locating feet extending from the body for locating the tool in substantially upwardly extending fashion relative to a selected one of a number of frets associated with the guitar neck and in proximity to the guitar head. Preferably, the tool is arrayed in substantially upwardly extending fashion at a location ranging from the first, second or third frets.

The tool also includes an upper end defining a plurality of individually stepped shoulders corresponding to each of the plurality of guitar strings to be installed. An initial or lower-most stepped shoulder corresponds to the largest diameter or E (low) string and succeeding upwardly stepped shoulders correspond, respectively, with the further A, D, G, B, and E (high) strings.

A removal portion is integrally defined in the body and is adapted to remove pegs installed at the rear location of the guitar and for holding the strings in place. The removal portion is defined as a tab projecting from a selected location of the tool and including an angled ramp which, when manipulated in place, is engageable with an underside facing location of a selected guitar peg and forcible disengages the peg from the guitar.

Tuning spindles are located on a head of the guitar and each further includes a nut portion rotatably associated with the upwardly extending spindle. The tool further includes an integrally defined wrench portion adapted to rotatably engage a selected nut portion. In use, each guitar string is drawn over a selected stepped shoulder of the tool arrayed upon the guitar neck and so that a trailing end of the string is engaged with an associated tuning spindle with the string taut while the tool is in place. Upon removal of the tool from the guitar frets, the user begins winding the tuning key until the string is in tune. At this point, all spindles will have the proper number of wraps.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
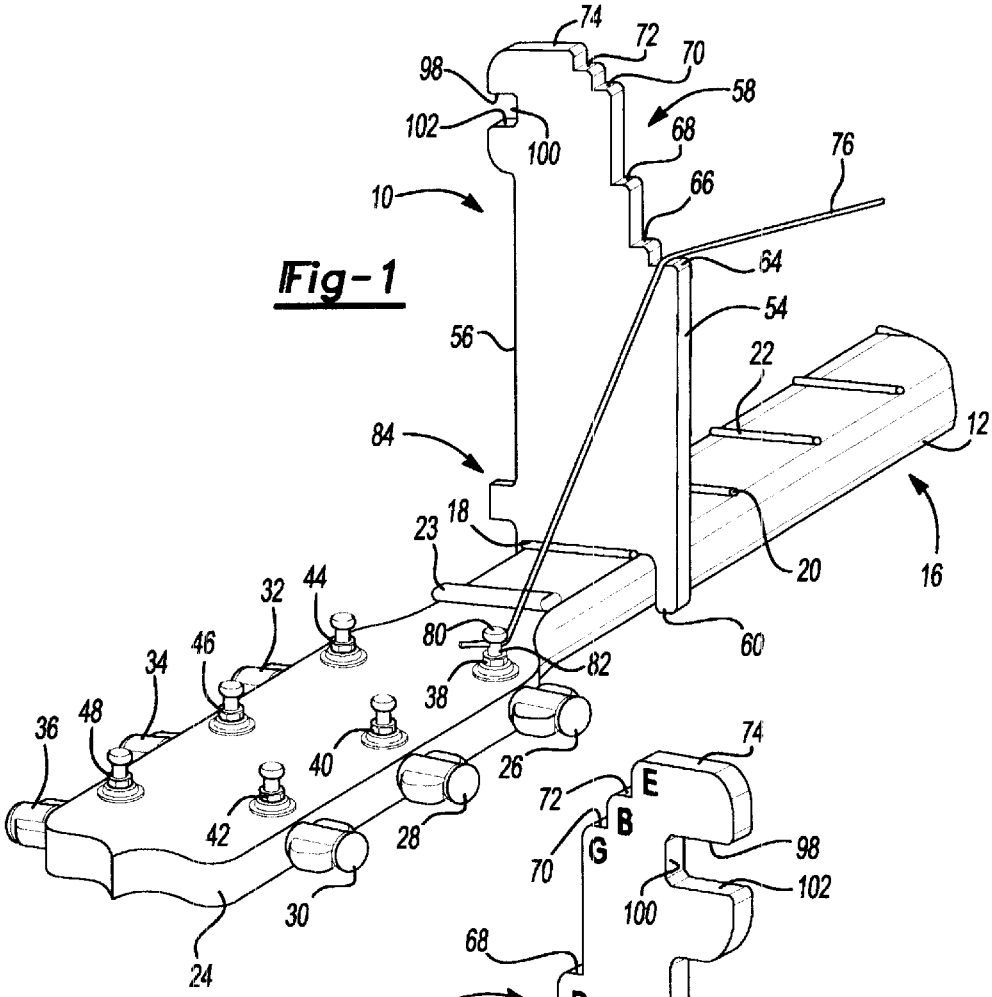
FIG. 1 is an environmental view illustrating the tool of the present invention arrayed in position relative to the guitar head and defining a selected desired length of pre-slack in a string to be installed on the guitar.
Figure 2:
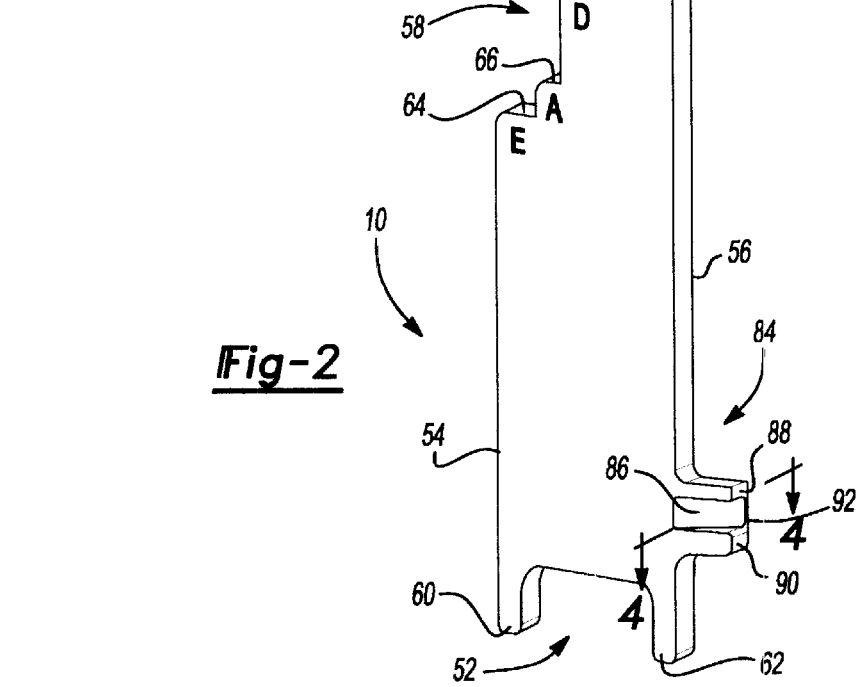
FIG. 2 is a perspective view of the tool according to the present invention and illustrating the features of the individually stepped shoulder locations for establishing the proper pre-slacking of each of the guitar strings, as well as the ancillary features of the nut tightening wrench and the engagement tool for removing conventional and rearwardly positioned string pegs on the guitar.
Figure 3:
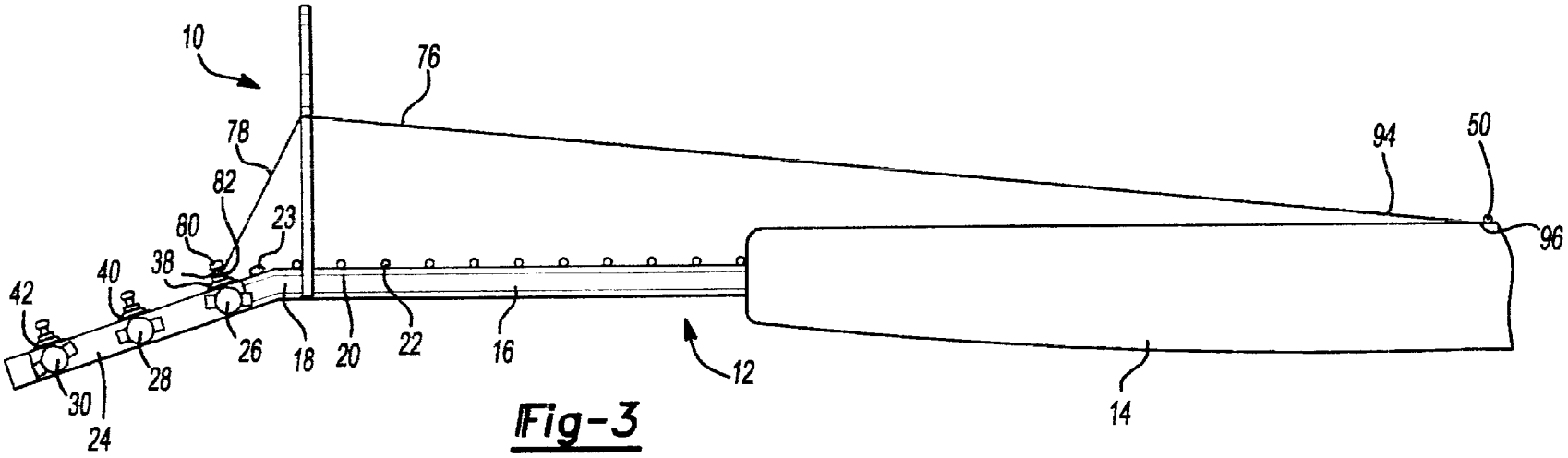
FIG. 3 is a substantial side view of the guitar head/neck and the tool according to the present invention.

Referring to FIGS. 1–3, a tool is illustrated at 10 for use with a guitar (generally illustrated at 12) and, in particular, for establishing a proper degree of initial spacing (or slack) in each of a plurality of individual guitar strings (typically E, A, D, G, B, E (high)) when initially attached to respective head and rear locations on the guitar, and prior to tightening/wrapping the strings about the guitar head. The present invention is further an improvement over prior art guitar stringing attachments in that it establishes a correct amount of slack for a given string and which will be correctly tensioned with a specified number of turns or wraps about a specified spindle associated with the guitar head.

The guitar is illustrated generally at 12, with a main base 14 and an extending neck 16 with frets 18, 20, 22, etc., extending in spaced fashion from a string guide or nut 23 located proximate a head 24 of the guitar 12. The head 24 in turn includes individual tightening nuts 26, 28, 30, 32, 34, 36 corresponding to associated tuning spindles 38, 40, 42, 44, 46 and 48 and as is known in the art. While the guitar head is illustrated in substantially linear fashion in the perspective view of FIG. 1 (and in order for ease of illustration), it is conventionally known that the head 24 is established at a specified bend or angle relative to the guitar neck 16 and as is further evidenced by the side profile of FIG. 3. As is also best shown by the side view of FIG. 3, a plurality of additional and fixed pegs are located toward a rearward end of the guitar (one for each of the guitar strings) and is representatively illustrated by peg 50.

While illustrating one general and conventionally known embodiment of a guitar, it is understood that the tool according to the present invention is capable of being used with both acoustic and electric guitars of varying design and within the scope of the present invention. In particular, the tool may be employed with such guitars (without limitation) and as are known under the commercial names Stratocaster, Telecastor and Gibson.

The tool 10 includes a substantially planar and elongate extending body having a lower end 52, first and second generally planar and upwardly extending sides 54 and 56, and an upper end illustrated in gradually stepped manner at 58. In a preferred embodiment, the tool 10 is constructed of a durable plastic or like polymer material (for easy and inexpensive manufacture) and is established with a specified length, width and thickness. However, it is further understood that the construction of the tool body is not limited to any specific set of dimensions or material construction and other and different configurations can be adopted within the scope of the invention.

The lower end 52 of the tool is further defined by first 60 and second 62 downwardly projecting and locating feet. The purpose of the locating feet 60 and 62 is to position the tool 10 in substantially upwardly arrayed fashion relative to a selected fret of the guitar neck. In a preferred application, it is desirous to locate the tool at a point just behind the first guitar fret 18, however the tool 10 can be effectively employed at a number of points along the neck, and in particular at locations both along and between the first 18, second 20 and third 22 frets. It is also contemplated that the configuration and arrangement of the locating feet 60 and 62 can be modified or reconfigured dependent upon the construction of the guitar neck and frets and so as to properly align and locate the tool 10.

The stepped upper end 58 of the tool 10 is more specifically defined by a plurality of individual and succeeding, upwardly stepped shoulders, each of which is placed at an elevated location to correspond with a selected one of the strings of the guitar 12. In a preferred embodiment, a plurality of first 64, second 66, third 68, fourth 70, fifth 72 and sixth 74 stepped shoulders are arranged in succeeding upward fashion and which correspond to the six guitar strings to be installed.

In use, a first E string of the guitar (see at 76 in FIGS. 1 and 3) is secured in conventional fashion at one end by a selected guitar peg (see again at 50). The string 76 is then drawn over the first stepped shoulder 64 and so that a trailing end 78 is engaged about a pintle and nut portion associated with the first selected tuning peg 38. Referring again to the enlarged view of FIG. 1, a top pintle 80 and rotatably associated locking nut portion 82 are illustrated as forming parts of the first tuning spindle 38 and as is known in the conventional guitar art. Identical pintle and nut portions are illustrated for each of the succeeding tuning spindles 40, 42, 44, 46 and 48 however, and for ease of illustration, duplicative description is unnecessary.

Upon being drawn through an aperture defined in the associated pintle (see again at 80 in FIGS. 1 and 3) the trailing end 78 of the first string 76 (E low) is tautened with the tool 10 in place. The tool 10 is then removed and so as to define a specified amount of slack in the string 76, which is subsequently wrapped, typically by rotating the nut portion (82) of the selected tuning spindle (38) and in order to ensure a proper number of wraps around the spindle, each spindle further being understood to require a different number of wraps to maintain the selected string in tune and without breaking the string from overtightening.

In the preferred embodiment, slackened first string is wrapped three turns about the first guitar tuning spindle 38. In similar fashion, the second A string (not shown) is drawn in identical fashion over the second stepped shoulder 66 and subsequently wrapped three and one-half turns about the second guitar tuning spindle 40. In succeeding fashion, the third D string is drawn over the third stepped shoulder 68 and subsequently wrapped four and one-half turns about the third guitar tuning spindle 42, the fourth G, fifth B and sixth (E high) strings being drawn in further succeeding fashion over the fourth 70, fifth 72 and sixth 74 stepped shoulders, respectively, and subsequently wrapped seven, eight, and ten turns, respectively, about the fourth 44, fifth 46 and sixth 48 guitar tuning spindles. Upon establishing a correct number of wrappings of a selected guitar string, and in order to properly tighten and tension the string, the tightening nut (26–36) associated with the given tuning spindle (spindle/nut portion) is rotated and to secure the guitar string in place.

Figure 4:
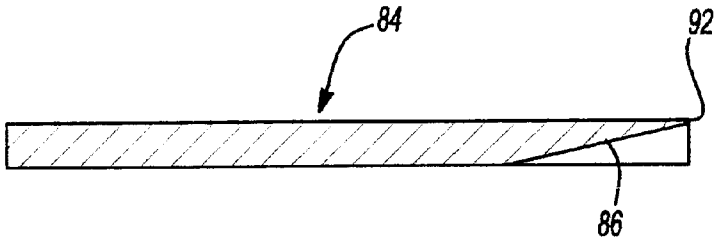
FIG. 4 is a cutaway view taken along line 4—4 of FIG. 2 and further illustrating the angled inner configuration of the guitar peg removal portion.

Additional features of the tool 10 include the provision of an integrally defined peg removal portion 84. As best illustrated in FIG. 2, the peg removal portion 84 includes a tab portion projecting from a selected lateral location of the tool 10, in this case from a lower position along the second extending side 56. An angled ramp 86 (see also cutaway of FIG. 4) is defined between first 88 and second 90 spaced apart sides and terminates in a substantially pointed fashion with an outwardly projecting end 92 of the removal portion 84.

A representative and rearwardly situated peg 50 is again illustrated in the side view of FIG. 3 and it is again understood that a number of such pegs, typically equal to the number of strings to be attached, is provided. Upon being manipulated in place, the pointed end 92 of the tab is engageable with an underside facing location (see at 94 in FIG. 3) of the selected guitar peg 50. Upon further being deflected in an upward fashion, the tab causes the peg 50 to be dislodged from the guitar and, accordingly, the associated rear end of the guitar string (see further at 96 for first string 76) is released from the guitar 12.

As a yet additional feature, the tool 10 further includes an integrally defined wrench portion defined at an upward location along the selected side 56 of the tool and adapted to rotatably engaging a selected locking nut portion of an associated tuning spindle. The wrench portion is further defined by inwardly recessed and interconnecting surfaces 98, 100 and 102 and which are configured and dimensioned to appropriately receive therebetween and to rotated the selected locking nut portion, associated with the spindles, such as again at 82. The incorporation of the peg removal portion and wrench portion are understood to provide additional and useful aspects of the tool 10, and in order to render it multi-functional, however it is further understood that these components could be deleted without departing from the scope of the invention.

Having described my invention, additional preferred embodiments will become apparent to those skilled in the art to which it pertains, and without deviating from the scope of the appended claims. In particular, the tool can be reconfigured for use with guitars having other pluralities of strings (e.g., 4, 5, 7, 8, 9, 10, etc.). It is also envisioned that the stepped shoulders could, in some instances, be reconfigured in a number of differing variations for individually securing and spacing the requisite amount of slack to the varying guitar strings.

I claim:

1. A tool for use with a guitar for establishing a proper degree of pre-tightening slack in each of a plurality of guitar strings attached to respective head and rear locations of the guitar and prior to final tightening and wrapping of the strings, the guitar including a base, an extending neck having a plurality of spaced apart frets placed thereon, and terminating in a guitar head having a plurality of tightening nuts and associated tuning spindles, said tool comprising:

a substantially planar and elongate extending body having a lower end and an upper end;

said lower end further comprising positional means for locating said body in upwardly extending fashion relative to a selected one of the frets of the guitar neck, said positional means further comprising first and second locating feet extending from said body; and said upper end further comprising a plurality of individually stepped shoulders corresponding to each of the plurality of guitar strings;

each guitar string being drawn over a selected stepped shoulder of said tool arrayed upon the guitar neck, a trailing end of the string being engaged with an associated tuning peg until the string is tautened with the tool in place, upon removal of said tool the tuning peg being rotated to wrap the string a selected number of turns to tension the string.

2. The tool as described in claim 1, the guitar further including a plurality of six strings corresponding to notes E, A, D, G, B and E (high), said tool further comprising first, second, third, fourth, fifth and sixth individually stepped shoulders.

3. The tool as described in claim 1, the guitar further including a plurality of rearwardly located fastening pegs, said tool further comprising an integrally defined peg removal portion.

4. The tool as described in claim 3, said peg removal portion further comprising a tab portion projecting from a selected lateral location of said tool, an angled ramp being defined within said tab portion and, upon being manipulated in place, engageable with an underside facing location of a selected guitar peg.

5. The tool as described in claim 1, the guitar tuning spindles each further including a locking nut portion rotatably associated with an upwardly extending pintle, said tool further comprising an integrally defined wrench portion adapted to rotatably engage a selected locking nut portion.

6. The tool as described in claim 1, said tool having a specified length, width and thickness, said positional means locating said tool in a range between first, second and third frets of the guitar neck proximate the guitar head.

7. The tool as described in claim 2, said tool having a specified length, width and thickness, the first E string being drawn over said first stepped shoulder and subsequently wrapped three turns about a first guitar tuning spindle, the second A string being drawn over said second stepped shoulder and subsequently wrapped three and one-half turns about a second guitar tuning spindle, the third D string being drawn over said third stepped shoulder and subsequently wrapped four and one-half turns about a third guitar tuning spindle, the fourth G string being drawn over said fourth stepped shoulder and subsequently wrapped seven turns about a fourth guitar tuning spindle, the fifth B string being drawn over said fifth stepped shoulder and subsequently wrapped eight turns about a fifth guitar tuning spindle, and the sixth E (high) string being drawn over said sixth stepped shoulder and subsequently wrapped ten turns about a sixth guitar tuning spindle.

8. A tool for use with a guitar for establishing a proper degree of pre-tightening slack in each of a plurality of guitar strings, said tool comprising:

a substantially planar and elongate extending body having a specified length, width and thickness with a lower end defining a positional means for locating said body in upwardly extending fashion relative to a selected one of a plurality of frets associated with a neck of the guitar, said body further having an upper end comprising a plurality of individually stepped shoulders corresponding to each of the plurality of guitar strings; and each guitar string being drawn over a selected stepped shoulder of said tool arrayed upon the guitar neck, a trailing end of the string being engaged with an associated tuning spindle until the string is tautened with the tool in place and, upon removal of said tool from said located position relative to said selected fret, the tuning peg being rotated to wrap the string a selected number of turns and to tension the string.

9. A tool for use with a guitar for establishing a proper degree of pre-tightening slack in each of a plurality of guitar strings attached to respective head and rear locations of the guitar and prior to final tightening and wrapping of the strings, the guitar including a base, an extending neck having a plurality of spaced apart frets placed thereon, and terminating in a guitar head having a plurality of tightening nuts and associated tuning spindles, said tool comprising:

a substantially planar and elongate extending body having a lower end and an upper end;

said lower end further comprising first and second locating feet extending from said body for locating said tool in substantially upwardly extending fashion relative to a selected one of the frets of the guitar neck;

said upper end further comprising a plurality of individually stepped shoulders corresponding to each of the plurality of guitar strings;

a removal portion integrally defined in said body and adapted to remove pegs installed at the rear location of the guitar; and the guitar tuning spindles each further including a locking nut portion rotatably associated with an upwardly extending pintle, said tool further comprising an integrally defined wrench portion adapted to rotatably engaging a selected locking nut portion;

each guitar string being drawn over a selected stepped shoulder of said tool arrayed upon the guitar neck, a trailing end of the string being engaged with an associated tuning spindle until the string is tautened with the tool in place, upon removal of said tool from the frets, the locking nuts of the tuning spindles being engaged by said wrench portion and rotated a selected number of turns to wrap and tension the string.

10. A tool for use with a guitar for establishing a proper degree of pre-tightening slack in each of a plurality of guitar strings attached to respective head and rear locations of the guitar and prior to final tightening and wrapping of the strings, the guitar including a base, an extending neck having a plurality of spaced apart frets placed thereon, and terminating in a guitar head having a plurality of tightening nuts and associated tuning spindles, the guitar further including a plurality of six strings corresponding to notes E, A, D, G, B and E (high), said tool comprising:

a substantially planar and elongate extending body having a lower end and an upper end;

said lower end further comprising positional means for locating said body in extending fashion relative to a selected one of the frets of the guitar neck; and said upper end further comprising a plurality of first, second, third, fourth, fifth and sixth individually stepped shoulders corresponding to each of the plurality of guitar strings;

each guitar string being drawn over a selected stepped shoulder of said tool arrayed upon the guitar neck, a trailing end of the string being engaged with an associated tuning peg until the string is tautened with the tool in place, upon removal of said tool the tuning peg being rotated to wrap the string a selected number of turns to tension the string and such that the first E string being drawn over said first stepped shoulder and subsequently wrapped three turns about a first guitar tuning spindle, the second A string being drawn over said second stepped shoulder and subsequently wrapped three and one-half turns about a second guitar tuning spindle, the third D string being drawn over said third stepped shoulder and subsequently wrapped four and one-half turns about a third guitar tuning spindle, the fourth G string being drawn over said fourth stepped shoulder and subsequently wrapped seven turns about a fourth guitar tuning spindle, the fifth B string being drawn over said fifth stepped shoulder and subsequently wrapped eight turns about a fifth guitar tuning spindle, and the sixth E (high) string being drawn over said sixth stepped shoulder and subsequently wrapped ten turns about a sixth guitar tuning spindle.

11. A tool for use with a guitar for establishing a proper degree of pre-tightening slack in each of a plurality of guitar strings attached to respective head and rear locations of the guitar and prior to final tightening and wrapping of the strings, the guitar including a base having a plurality of rearwardly located fastening pegs, an extending neck having a plurality of spaced apart frets placed thereon, and terminating in a guitar head having a plurality of tightening nuts and associated tuning spindles, said tool comprising:

a substantially planar and elongate extending body having a lower end and an upper end;

said lower end further comprising positional means for locating said body in extending fashion relative to a selected one of the frets of the guitar neck;

said upper end further comprising a plurality of individually stepped shoulders corresponding to each of the plurality of guitar strings; and said tool further comprising an integrally defined peg removal portion;

each guitar string being drawn over a selected stepped shoulder of said tool arrayed upon the guitar neck, a trailing end of the string being engaged with an associated tuning peg until the string is tautened with the tool in place, upon removal of said tool the tuning peg being rotated to wrap the string a selected number of turns to tension the string.

12. A tool for use with a guitar for establishing a proper degree of pre-tightening slack in each of a plurality of guitar strings attached to respective head and rear locations of the guitar and prior to final tightening and wrapping of the strings, the guitar including a base, an extending neck having a plurality of spaced apart frets placed thereon, and terminating in a guitar head having a plurality of tightening nuts and associated tuning spindles, the tuning spindles each further including a locking nut portion rotatably associated with an upwardly extending pintle, said tool comprising:

a substantially planar and elongate extending body having a lower end and an upper end;

said lower end further comprising positional means for locating said body in extending fashion relative to a selected one of the frets of the guitar neck;

said upper end further comprising a plurality of individually stepped shoulders corresponding to each of the plurality of guitar strings; and said tool further comprising an integrally defined wrench portion adapted to rotatably engage a selected locking nut portion;

each guitar string being drawn over a selected stepped shoulder of said tool arrayed upon the guitar neck, a trailing end of the string being engaged with an associated tuning peg until the string is tautened with the tool in place, upon removal of said tool the tuning peg being rotated to wrap the string a selected number of turns to tension the string.

13. A tool for use with a guitar for establishing a proper degree of pre-tightening slack in each of a plurality of guitar strings attached to respective head and rear locations of the guitar and prior to final tightening and wrapping of the strings, the guitar including a base, an extending neck having a plurality of spaced apart frets placed thereon, and terminating in a guitar head having a plurality of tightening nuts and associated tuning spindles, said tool comprising:

a substantially planar and elongate extending body having a lower end and an upper end;

said lower end further comprising positional means for locating said body in extending fashion relative to a selected one of first, second and third frets of the guitar neck proximate the guitar head; and said upper end further comprising a plurality of individually stepped shoulders corresponding to each of the plurality of guitar strings;

each guitar string being drawn over a selected stepped shoulder of said tool arrayed upon the guitar neck, a trailing end of the string being engaged with an associated tuning peg until the string is tautened with the tool in place, upon removal of said tool the tuning peg being rotated to wrap the string a selected number of turns to tension the string.

* * * * *